US005785603A

United States Patent [19]

Lazier

[11] Patent Number: 5,785,603

[45] Date of Patent: Jul. 28, 1998

[54] GOLF SWING TEACHING AID

[76] Inventor: Murney M. Lazier, 5140 Fair Elms, Western Springs, Ill. 60558

[21] Appl. No.: 826,839

[22] Filed: Apr. 8, 1997

[51] Int. Cl.[6] ..... A63B 69/36

[52] U.S. Cl. ..... 473/215; 273/DIG. 30; 473/277

[58] Field of Search ..... 473/215, 277; 273/DIG. 30

[56] References Cited

U.S. PATENT DOCUMENTS 4,519,608 5/1985 Gilly ..... 473/215 X
4,922,850 5/1990 Conley ..... 273/DIG. 30
5,658,203 8/1997 Shub ..... 473/215 X

*Primary Examiner*—George J. Marlo
*Attorney, Agent, or Firm*—McDonnell Boehnen Hulbert & Berghoff

[57] ABSTRACT

A golf swing teaching aid has been designed to teach a golfer the proper amount of torso and back rotation in executing a back swing for a tee or iron stroke. The teaching aid comprises a harness worn over the golfer's back and an elongate wand that attaches to the harness and extends laterally to the golfer's side. When the golfer stands next to the ball and executes the back swing, the tip of the wand is rotated into a predetermined visual relationship with the ball. Preferably, the tip of the wand is rotated into approximately a plane containing the golf ball and the golfer's eye.

18 Claims, 7 Drawing Sheets

GOLF SWING TEACHING AID

BACKGROUND OF THE INVENTION

A. Field of the Invention

This invention relates to sport of golf, and more particularly to the subject of devices or aids in improving a golfer's swing.

B. Description of Related Art

The execution of a golf swing having the proper form, on a consistent basis, is a difficult movement involving virtually the entire body. It is particularly challenging for those that are just beginning to learn the game or who have not played for a long period of time. Most golfers endeavor to improve their game, even experienced players, and the area that is most critical to success at the game is the execution of the golf swing. This observation applies for tee shots, as well as iron shots and putting strokes. Even the best of equipment will not make a golfer improve substantially if the golfer's form is not conducive to accurate shots on a consistent basis.

To date, there have been relatively few golf teaching aids that have been developed that are suitable for use on the course and that offer practical guidance as proper execution of a golf swing. One such device, developed relatively recently, is an article worn over the golfer's wrist that makes a "pop" sound if the golfer bends their wrist during the execution of a golf stoke. Early indications are that the device is quite popular among golfers, since it offers an easy teaching aid to develop the muscle memory to not snap or bend the wrist during the golf stroke. However, this device is limited, in that while it teaches the golfer better habits in holding the club during the swing, it does little or nothing to help the golfer in other aspects of the mechanics of the swing.

The present invention was developed to assist a golfer in achieving a proper back swing for a golf stroke, and in particular the learning of the proper rotation of the torso and back in the back swing. To the knowledge of the inventor, the prior art has failed to provide a teaching aid for this part of the golfers game that can be utilized in the house, yard, or on the practice range and provide tangible assistance in perfecting this aspect of the golf swing.

SUMMARY OF THE INVENTION

The present invention comprises a golf teaching aid for improving the swing of a golfer that is useable for practice, and which offers specific and practical guidance to execution of a proper back swing. The invention comprises, in combination, (1) a harness-like garment to be worn by the golfer over the golfer's upper body which has a back panel covering a portion of the golfer's back, and (2) an elongate wand having a first end that is removeably attachable to the back panel of the harness and a second free end. The first end of the wand attaches to the back panel of the harness in a manner such that, when the first end of the wand is attached to the back panel and the harness is worn by the golfer, the wand extends generally outwardly from the back panel substantially laterally, i.e., it lies in a plane roughly coincident with the golfer's back. The wand is attached to the harness such that the wand extends outwardly and to the side to the golfer's left for a right-handed golfer, and to the golfer's right for a left-handed golfer.

In use, when the golfer stands opposite a golf ball to be struck and in a position square to the hole, the wand is oriented to the side of the golfer in the general direction of the desired destination of the ball. A key ingredient in developing a successful back swing is the proper amount of rotation of the torso and back, and this is where the wand and harness, connected to each other as described above, assist the golfer. The golfer, holding the club, executes the back swing. In the process of executing the back swing, the golfer's rotates the torso and back, and thus the wand, attached to the harness and pointing out the side of the golfer, is swung around to point in a direction generally in front of the golfer and slightly downward towards the ground in front of the golfer. As the second or free end of the wand comes around generally in front of the golfer, the visual observation of the position of the free end of the wand relative to the golf ball gives the golfer has an idea of how much the back has been rotated. When the free end of the wand lies roughly in the same plane as a plane containing the golf ball and the golfer's eye, or perhaps has been rotated just slightly past the line of sight to the golf ball, the golfer's back and torso have been rotated the proper amount to execute a golf swing in accordance with a generally accepted desirable golf swing form.

Preferably, the first end of the wand is attached to the back panel of the garment or harness in a position to the side of the spine and in the mid-scapula portion of the back, i.e., in the same elevation as the middle of the scapula and just to the side of the spine, on the left side of the back for a right-handed golfer and on the right hand side of the spine for a left-handed golfer. With the first end of the wand in this position, the golfer rotates their torso such that the free end of the wand comes into approximate visual alignment with a plane containing the golf ball, i.e., the free end lies approximately in a plane containing the golfer's eye and the golf ball. This visual alignment between the golfer's eye, the free end of the wand and the golf ball indicates that the golfer's back has rotated a full 90 degrees from the initial condition prior to executing the back swing, and thus is in accordance with a generally accepted and desired golf swing form. Precise visual alignment between the golf ball and the free end of the wand is not necessary. The general idea is that when the free end of the wand has is generally coincident with a plane containing the golfer's eye and the ball the proper amount of torso rotation has occurred. Further, precise visual alignment is not required since it depends on the length of the wand, the position of the wand on the golfer's back, and the golfer's stance relative to the golf ball. However, for best results, the wand is given a length of between 24 and 28 inches and is positioned in the back panel of the harness as described above.

Within this overall conception, there are a number of specific features that may be optionally provided that promote ease of use and convenience of the harness and wand. One feature is providing the wand with a telescoping capability, whereby the wand may be shortened or lengthened to suit the individual needs of golfers of varying sizes.

A second feature is that the wand may be constructed in a fashion that allows the wand to pivot between the lateral orientation and a vertical orientation, to thereby allow the wand to be moved out of the way after the golfer has executed the swing and is ready to proceed to the location of the ball.

A third feature is that the free end of the wand may be provided with a distinctive object or other means to help the golfer easily observe the location of the tip of the wand. For example, the wand may have a white or colored ball at the tip of the wand. The ball or other equivalent object or device assists the golfer to rotate the torso and back to obtain an approximate alignment of the free end of the wand with the golf ball during the back swing.

These and many other aspects, features and advantages of the invention will be more apparent from the following detailed description.

BRIEF DESCRIPTION OF THE DRAWINGS

Presently preferred embodiments of the invention will be described in detail below in conjunction with the appended drawing figures, in which like references refer to like elements in the various views, and in which.

DETAILED DESCRIPTION OF THE PREFERRED EMBODIMENT

Figure 1:
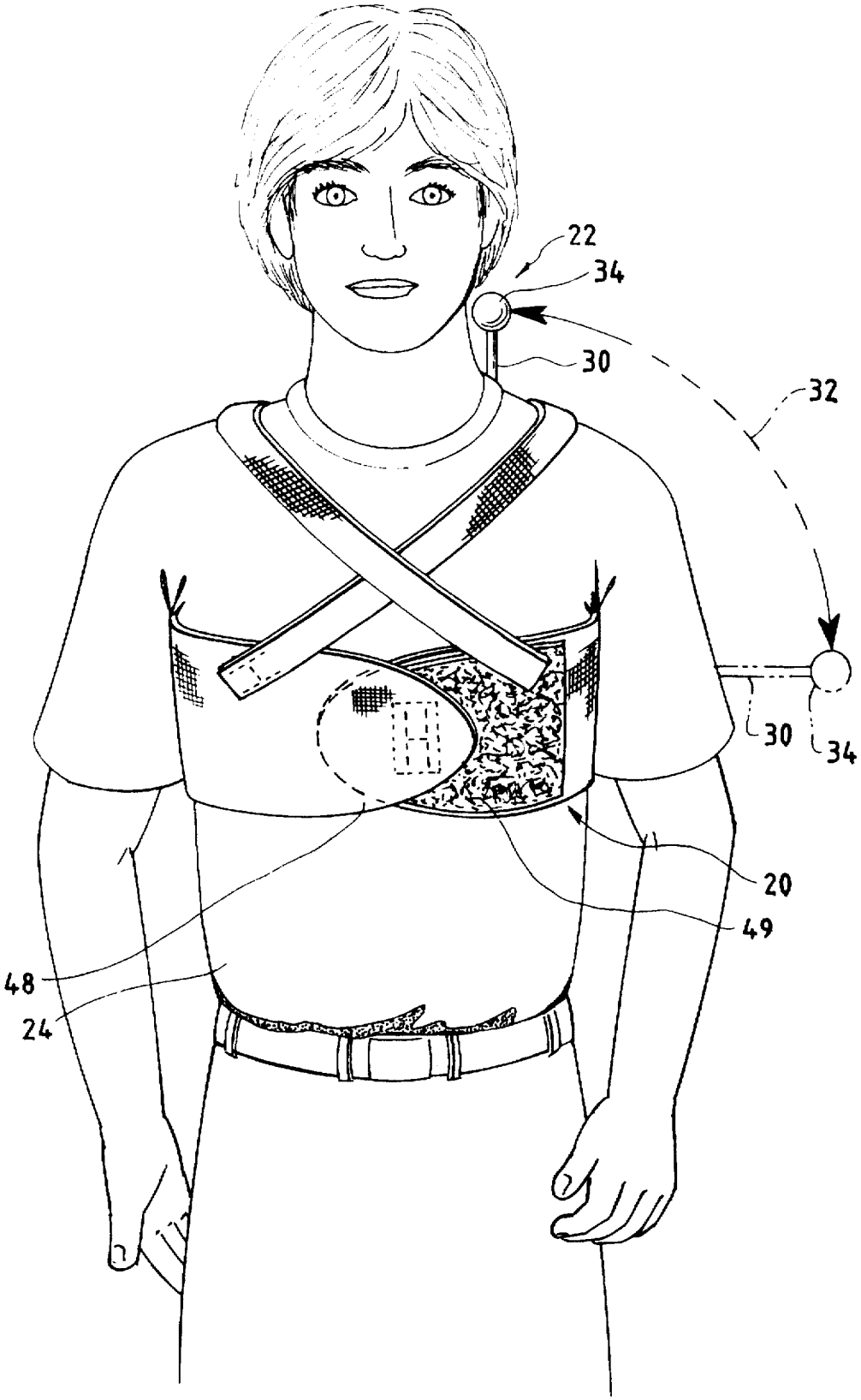
FIG. 1 is a front view of a golfer wearing a harness in accordance with the invention, with the wand rotated to a vertical position as it would be before execution of a back swing, and with dashed lines indicating the ability of the wand to rotate between a vertical position and a position extending laterally to the side of the golfer when the golfer is ready to execute a swing.

The present invention comprises a golf teaching aid for improving the swing of a golfer which offers specific and practical guidance to execution of a proper swing. Referring to FIG. 1, the invention comprises, in combination, a harness-like garment 20 to be worn by the golfer 22 over the golfer's torso 24 which has a back panel 26, shown best in FIG. 2, covering a portion of the golfer's back 28, and an elongate wand 30 having a first end (not shown in FIG. 1) that is removably attachable to the back panel 26 of the harness 20 and a second free end 34.

The first end of the wand 30 attaches to the back panel 26 of the harness 20 in a manner such that, when the first end 34 of the wand is attached to the back panel 26 and the harness 20 is worn by the golfer, the wand 30 is extended generally outwardly from the back panel 26 substantially laterally, i.e., it lies in a plane roughly coincident with the golfer's back. This lateral orientation is indicated by the position of the wand 30 shown in dashed lines in FIG. 1. FIG. 1 also shows the wand 30 in a vertical position, the position it would typically be moved to by the golfer 22 before and after the execution of the swing so as to be out of the way. The movement of the wand from the vertical position to the lateral position, indicated by the arrow 32, is achieved by means a pivot capability built into the first end of the wand 30 and described in detail below. During the swing, however, the wand is oriented to the golfer's side as shown in dashed lines in FIG. 1 and as shown in FIGS. 6A–6F and as described in detail below. Further, the wand 30 is attached to the harness 20 such that the wand extends outwardly and to the side to the golfer's left for a right-handed golfer (as shown in dashed lines in FIG. 1), and to the golfer's right for a left-handed golfer.

Figure 2:
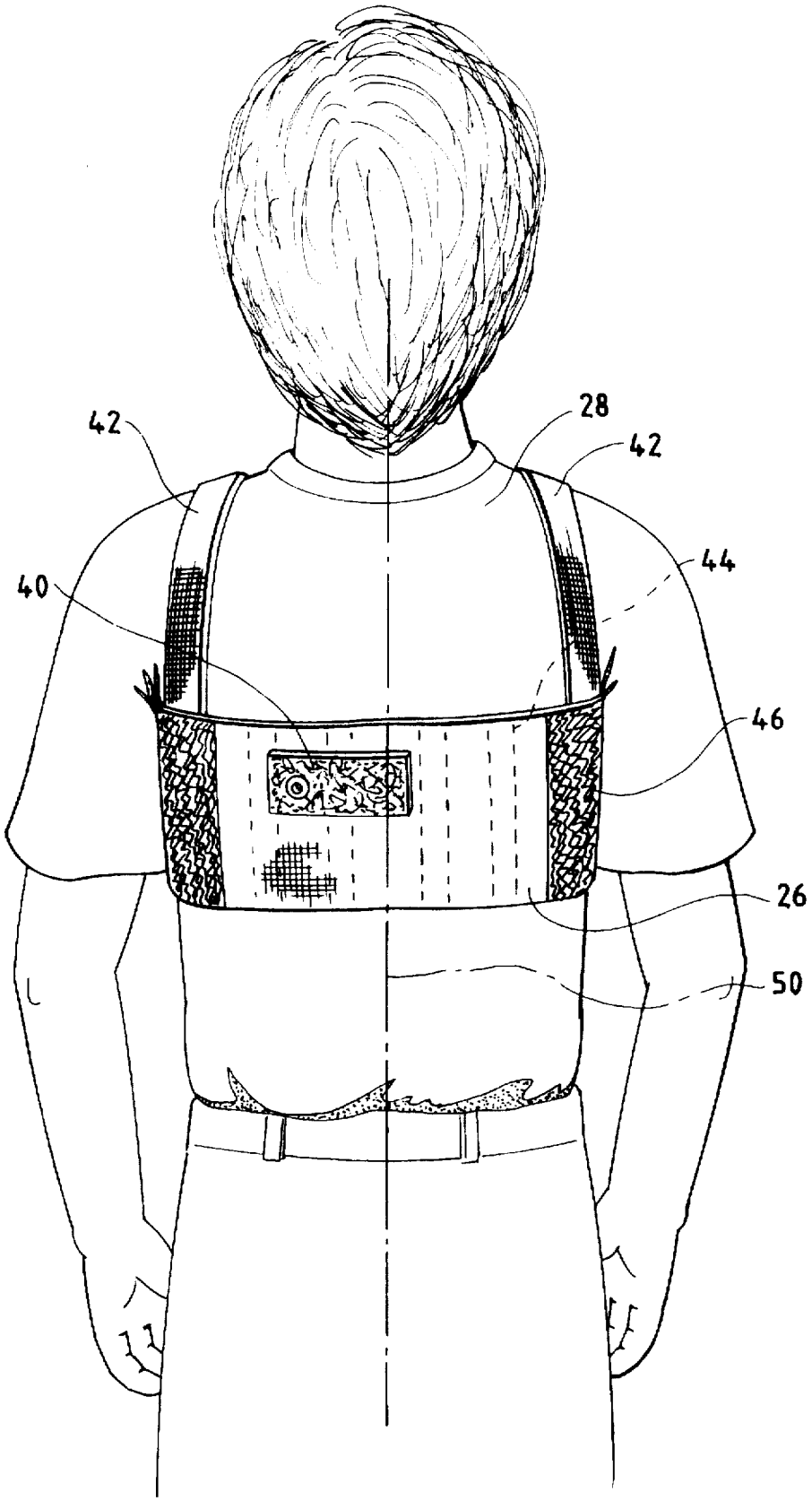
FIG. 2 is a rear view of the golfer of FIG. 1, showing the back panel of the harness of FIG. 1 with the wand removed, showing the patch of VELCRO-type hook or pile secured to the back panel that is used to attached the first end of the wand to the back panel of the harness.

FIG. 2 is a rear view of the golfer of FIG. 1, showing the back panel 26 of the harness 20 of FIG. 1 with the wand removed, in order to better illustrate a rectangular patch 40 of VELCRO-type hook projections (or pile) sewn or otherwise affixed to the harness. The patch 40 of hook projections is provided as a means for securely attaching a base member, shown in more detail in FIGS. 3 and 4 that is part of the first end of the wand 30, to the back panel 26 Two inch elastic straps 42 connect the back panel to 26 to the front of the harness. The particular harness 20 of FIGS. 1 and 2 has an internal reinforcing structure comprising parallel stays shown as 44. This feature is not necessary to the invention, but rather is an incident to an embodiment in which a back support having such stays is used as the basis for the harness 20. Preferrably, the back panel 26 is a relatively narrow band on the order of three or four inches in height compared to the full length of the back.

Referring to FIG. 1 and 2, the harness 20 has elastic band panels 46 which assist in making a snug and comfortable fit of the harness 20 over the golfer's clothing. The inside surface of the front panel 48 and the outside surface of front panel 49 of the harness 20 are supplied with a large area of complementary VELCRO-type hook and loop fasteners, respectively, to give a variety of adjustment positions for the harness 20. The entire harness 20 fits snugly over the golfer's clothing.

Referring to FIG. 2, the VELCRO-type hook (or pile) projection patch 40 is positioned slightly to the side of the midline 50 of the back panel coinciding with the golfer's spine, and preferably at the same elevation as the middle of the scapula as shown. This location is a preferred location, because this portion of the back should rotate during the execution of the back swing to a position which results in the free end of the wand being brought into approximate visual alignment with the ball at the top of the back swing as shown in FIG. 6C and explained below.

Figure 3:
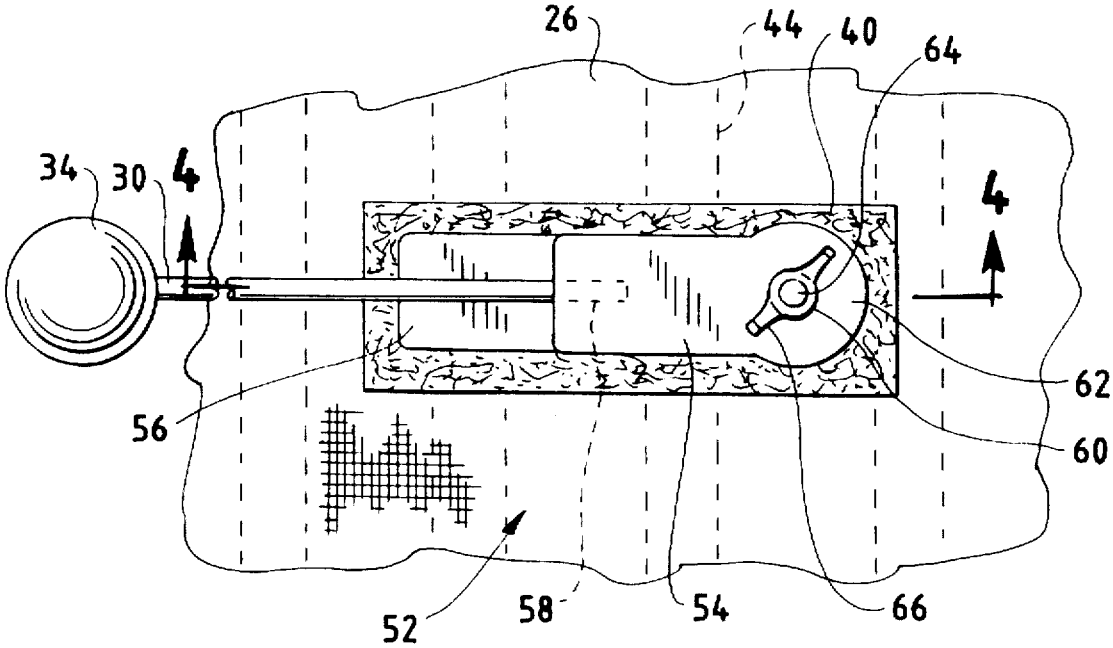
FIG. 3 is detailed plan view of back panel of FIG. 2, shown partially broken away, showing the fixation of the first end of the wand to the back panel.
Figure 4:
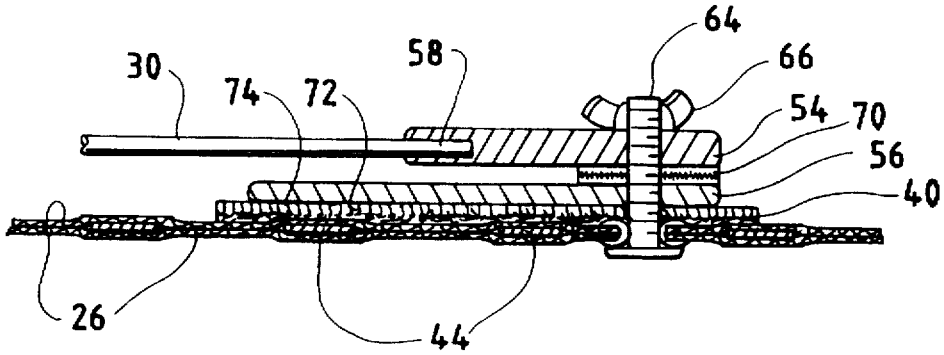
FIG. 4 is a cross-sectional view of the wand and back-panel of FIG. 3 taken along the lines 4—4 of FIG. 3.

A preferred construction of the first end 52 of the wand is shown in FIGS. 3 and 4. FIG. 3 is detailed plan view of a portion of the back panel 26 of FIG. 2, shown partially broken away, showing the first end 52 of the wand 30 comprising an end member 54 that is fastened to a base member 56. The base member 56 has a bottom surface that is covered with VELCRO-type hook or pile to be complimentary with the VELCRO patch 40 in order to secure the first end 52 of the wand 30 to the back panel 26.

FIG. 4 is a cross-sectional view of the wand 30 and back-panel 26 of FIG. 3 taken along the lines 4—4 of FIG. 3. Referring to FIGS. 3 and 4, the tip 58 of the wand 30 proper is press-fit into a receiving aperture in the rigid plastic end member 54. The end member 54 has a hole 60 in the head portion 62 to receive therethrough the shaft of a small threaded bolt 64. The bolt 64 passes though a hole in the base member 56 and through the end member 54 as shown in FIG. 4. A wing nut 66 threads onto the end of the bolt and tightens down to secure the end member 54 to the base member 56.

Preferably, a knurled sheet of material is applied to the head portion of one or more of the end member 54 and the base member 56 to provide friction between the two elements and prevent slipping between the end member and the base member when the wing nut 66 has been tightened. Fine sandpaper or the equivalent adhered to the top surface of the base member 56 or to the lower surface of the head portion of the end member 54, as indicated at 70 in FIG. 4, has proven satisfactory for this purpose. The knurled sheet of material or other means may be applied to both the end member and the base member to give even better friction and control against slippage.

The lower surface 72 of the base member 56 is covered by a complementary VELCRO-type fastener 74, enabling the entire wand 30 and base member and end member assembly 56/54 to be removably attached to the back panel 26. To give sufficient grip to the complementary hook and pile fasteners 40 and 74, a surface area of about 5–6 square inches for the lower surface 72 of the base member 56 has proven satisfactory.

When the wing nut 66 is loosened, the wand 30 and end member 54 may be moved by the golfer (or his and her partner) from the laterally extending position to the vertical position shown in FIG. 1, so as to move the wand 30 out of the way. In the construction of FIG. 4 with the friction means 70 between the end member and the base member, tightening the wing nut 66 to an intermediate position between loose and tight positions may enable the wand to be moved up to the vertical position and to the lateral position, without slippage of the end member relative to the base member during the execution of the swing.

Figure 5:
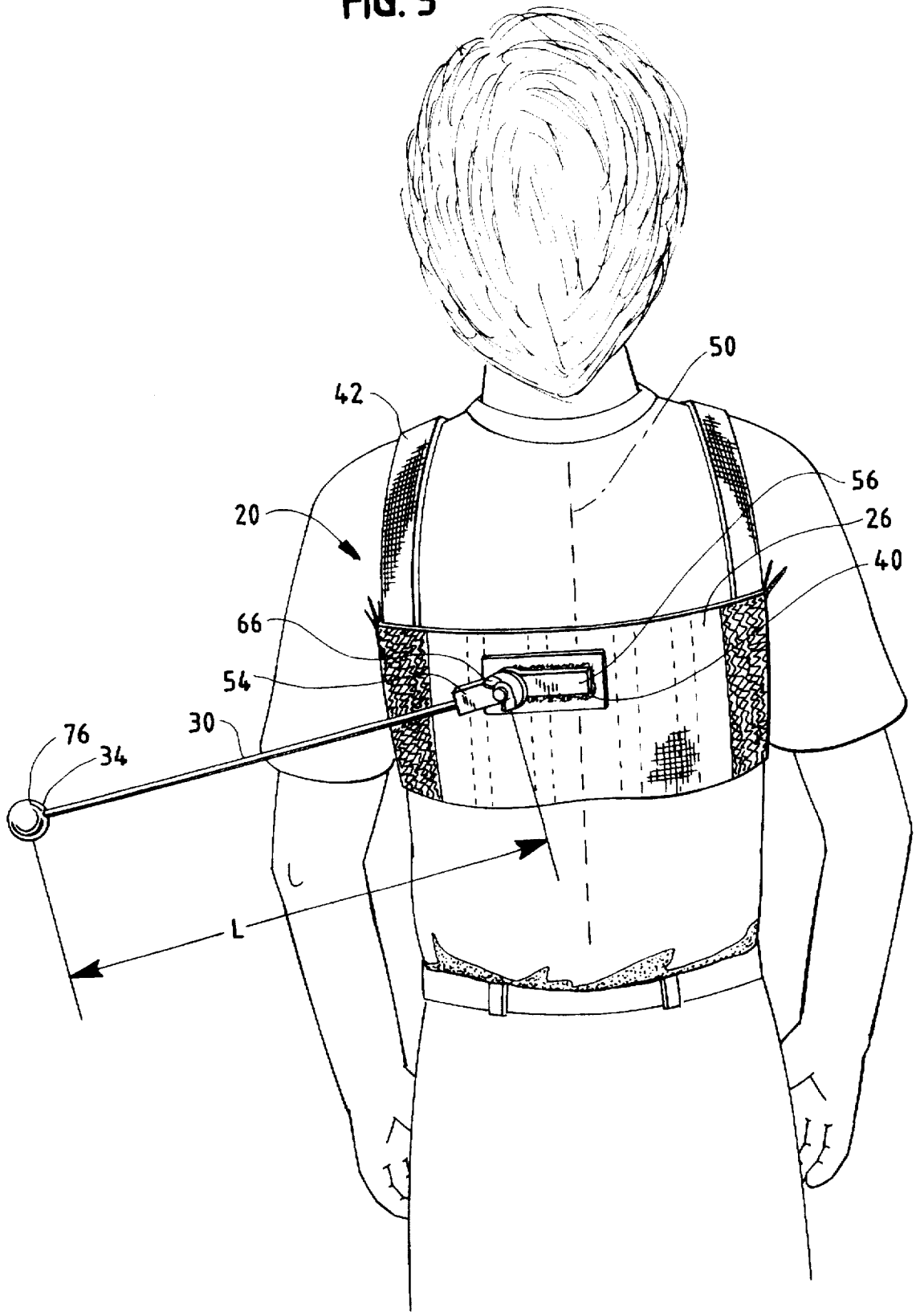
FIG. 5 is view of the rear of the golfer of FIG. 1 with the wand attached to the back panel of the harness.

FIG. 5 is view of the rear of the golfer of FIG. 1 with the wand 30 attached to the back panel 26 of the harness 20. The wand 30 is oriented generally laterally to the side of the golfer as it would be when the golfer is ready to execute the swing. When the golfer is standing in front of the golf ball, the wand 30 is oriented to the side in general alignment with the hole or desired destination for the ball. The total length L of the wand 30 (including the end member 54 in the measurement) that is ideal depends on the size of the golfer, but is between roughly 24 and 28 inches for most adult men and women. A length of between 18 and 44 inches for the wand would be suitable for just about any golfer. Preferably, the wand 30 itself is made from a metal with multiple telescoping sections such that the length L is adjustable in the field from a completely retracted form (for convenience) to an extended form of adjustable length. A collapsible radio-type antenna has proven especially suitable for the wand 30. In an embodiment having telescoping sections, preferably the wand is extendable to a length in the range of approximately between 24 and 28 inches, and, for maximum versatility, is extendible beyond that range to accommodate different size golfers.

The free end 34 of the wand 30 may be provided with an distinctive object or other means to help the golfer easily observe the location of the free end 34 of the wand. For example, the wand may have a white, striped or colored ball 76 at the tip of the wand 30. The ball 76 or other similar object or device assists the golfer to rotate the torso and back to obtain an approximate alignment of the free end of the wand with the golf ball at the top of the back swing.

FIGS. 6A–6F show how the harness and wand are used in a preferred embodiment. Specifically, they illustrate the sequence of motions taken by a golfer 22 wearing the harness 20 and wand 30 of FIGS. 1 and 5 in executing a golf swing having a desired form, showing the position of the wand 30 during each of the steps.

Figure 6A:
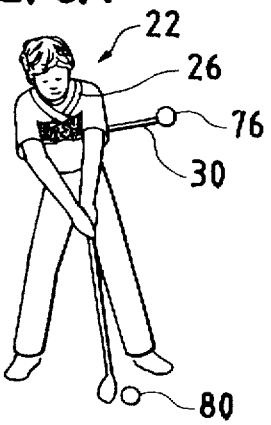
FIGS. 6A–6F show the sequence of motions taken by a golfer wearing the harness and wand of FIGS. 1 and 5 executing a golf swing having a desired form, showing the position of the wand during each of the steps, with FIG. 6C showing the approximate visual alignment of the golf ball and the tip of the wand at the top of the back swing.
Figure 6B:
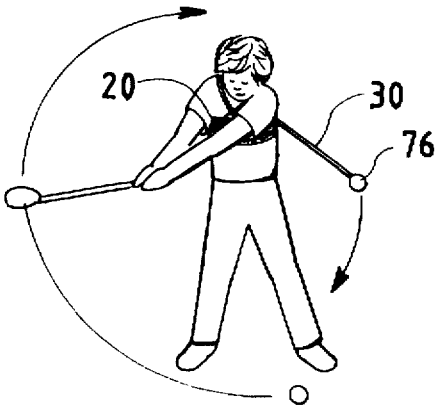
Figure 6C:
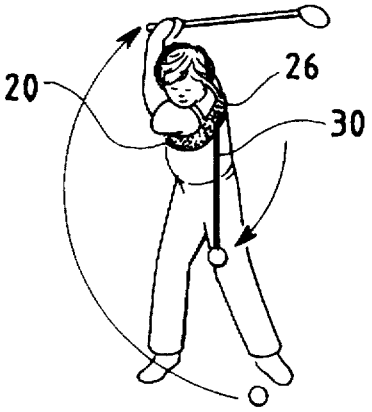

In FIG. 6A, the golfer 22 is positioned in front of the golf ball 80 and preparing to execute a golf swing in accordance with a desired golf swing form. The golfer is "square to the hole", with the wand 30 pointing in the general direction of the desired destination of the ball. The wand 30 need not be perfectly horizontal, and a slight downward angle of about 5–15 degrees is perfectly satisfactory. In FIG. 6B, the golfer begins the back swing, rotating his or her torso, and in the process swinging the wand 30 out in front of the golfer as indicated by the arrow. In FIG. 6C, the golfer is at the top of the back swing. By virtue of the placement of the first end of the wand 52 in the mid-scapula region of the back as described above, and with the wand 30 extended to a suitable length (roughly 24–28 inches for an average sized golfer), the ball 76 at the tip of the wand 30 appears to the eye of the golfer to lie in approximately in a plane containing the golf ball and the golfer's eye. The ball 76 is also roughly in alignment with the golf ball 80 itself if the wand is oriented slightly downwardly from the golfer's side when the golfer is standing erect. In other words, the golfer 22 has executed the proper amount of rotation of the torso and back when the tip of the wand has swung around such that the tip of the wand lies in a plane containing the golfer's eye and the ball. Only rough alignment is necessary to have the proper form. Too little back and torso rotation will result in the tip of the wand 30 not swinging around enough to approximately visually coincide with the plane containing the golfer's eye and the ball. Too much rotation will result in the tip of the wand rotating past the plane such that the tip appears to the right of a plane containing the golfer's eye and the golf ball.

Figure 6D:
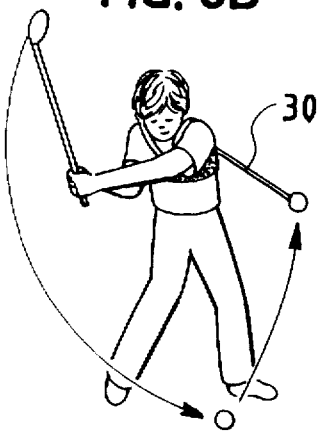
Figure 6E:
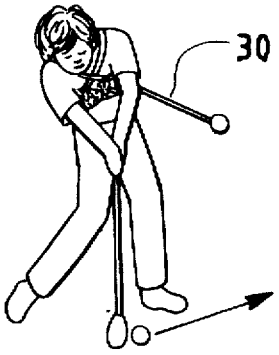
Figure 6F:
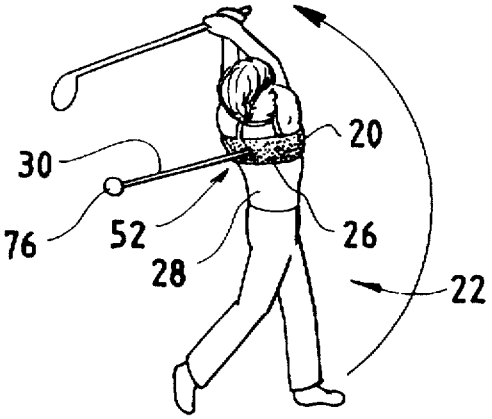

After the proper rotation has been achieved, as indicated in FIG. 6C, the golfer executes the downswing as shown in FIG. 6D. The wand is now swinging back as shown. The golfer makes impact as shown in FIG. 6E and executes a full swing follow-through as shown in FIG. 6F. Note that, by virtue of the low profile and light-weight antenna-like wand 30 and small lightweight ball 76 at the tip of the wand 30, air resistance and inertial forces attributable to the ball and wand in the steps illustrated in FIGS. 6D–6F are negligible.

Figure 7:
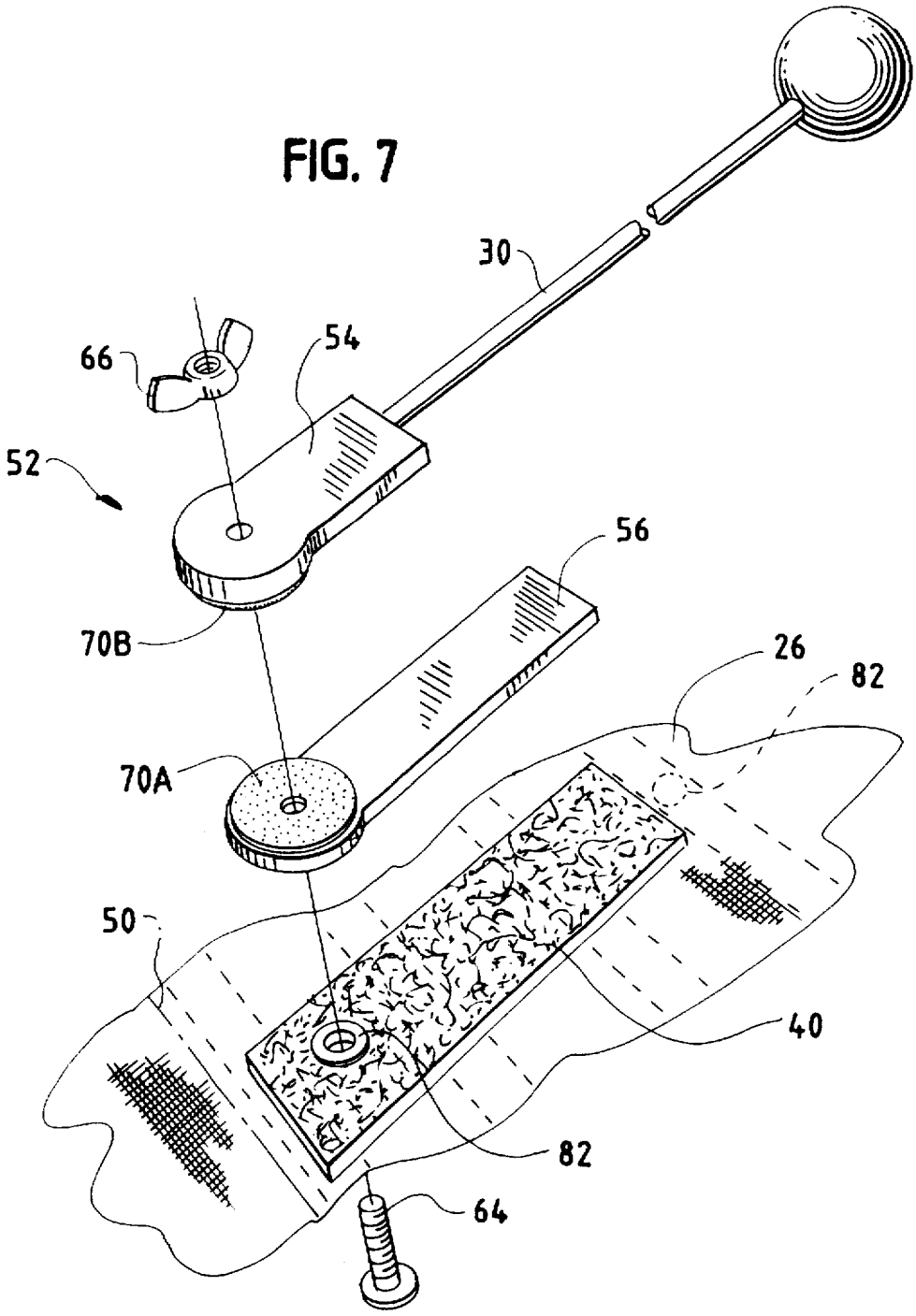
FIG. 7 s an exploded view of an alternative mounting arrangement for the back panel and first end of the wand.

FIG. 7 is an exploded view of an alternative construction of the back panel 26 showing a presently preferred mounting arrangement for mounting the first end 52 of the wand to the back panel 26. The back panel 26 has a grommet 82 adjacent to the patch 40 of hook or pile fastener. The grommet 82 may be positioned towards the medial line 50 of the back panel, as shown, or at the opposite end of the patch shown at 82'. The shank of the bolt 64 is inserted through the grommet 82 from below, and passes through the base member 56 and the end member 54. The wing nut 66 tightens down on the bolt 64 to secure the assembly together. A knurled frictional material such as fine sandpaper 70A is applied to the upper surface of the base member 56, and a similar material 70B is applied to the lower surface of the end member 54. The lower surface of the base member 56 has complementary hook or pile materially glued or otherwise affixed to the base member 56 to allow the base member to be securely fastened to the back fastener patch 40 in the panel 26 of the harness. When the golfer wishes to remove the wand 30, he or she removes the harness and loosens the wing nut 66 all the way and removes the bolt 64. The construction of FIG. 7 is a slightly more secure arrangement for the first end 52 of the wand as compared to the embodiment FIG. 3 and 4.

Various other methods may be used to attach the wand 30 to the harness 20. On the one hand, the wand may be essentially permanently fixed to the harness. More preferably, the wand is attachable to and removable from the harness by any convenient means. The precise manner in which the wand attaches to the harness is essentially unimportant. Several attachment mechanisms immediately come to mind, such as (1) providing complimentary hook and pile materials to the first end of the wand and the back panel, respectively (or vice versa) as described above, (2) using straps to secure the wand to the back panel, (3) providing a pocket or similar structure to the back panel to securely receive the first end of the wand, and (4) providing a fastening means such as a mounting screw or bracket to the harness that securely receives the first end of the wand. Of course, other alternatives can be devised within the spirit and scope of the invention.

Figure 8:
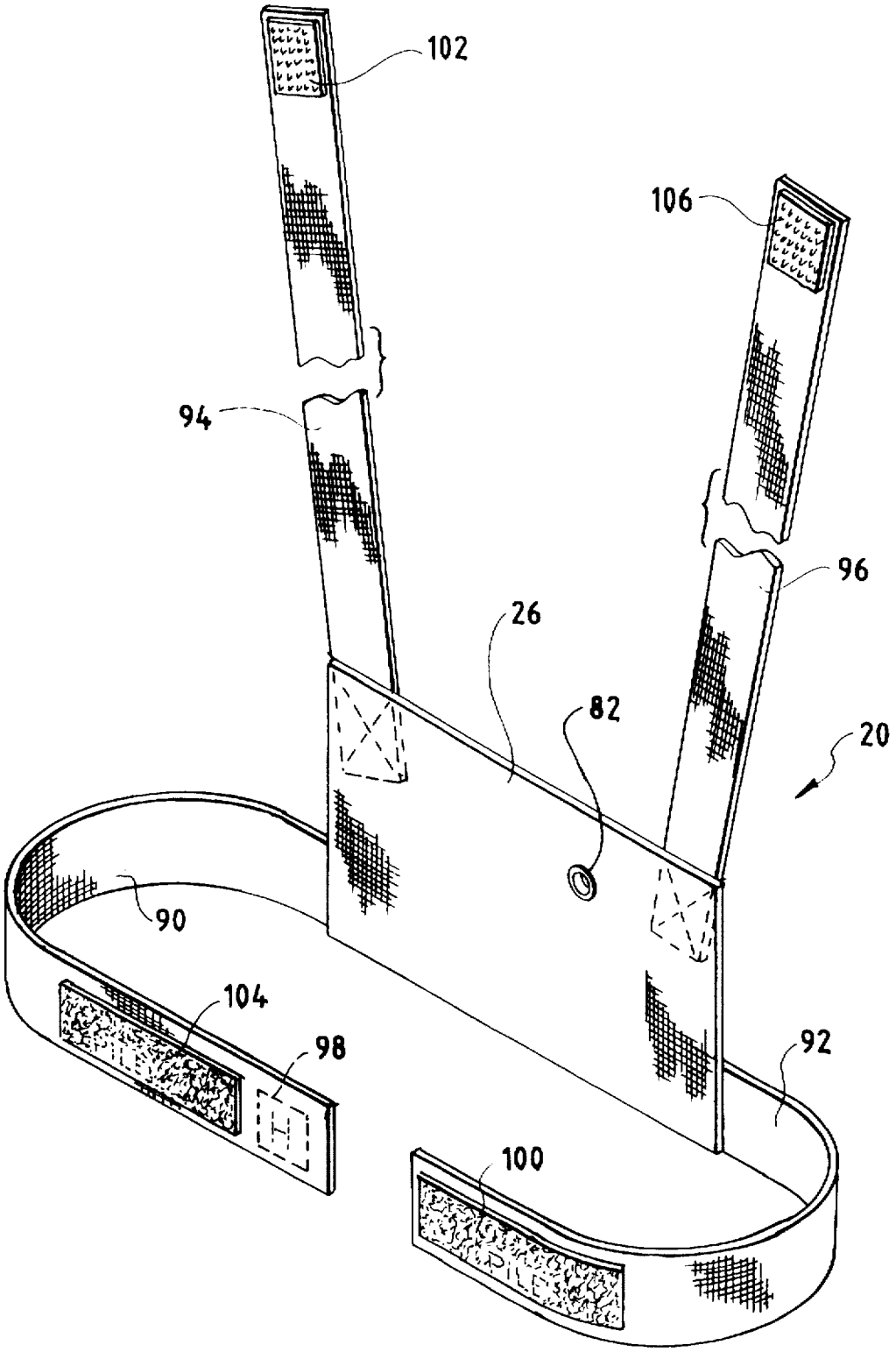
FIG. 8 is an illustration of a preferred unisex harness for use with the invention.

The particular back support-type harness 20 illustrated in FIG. 1 and FIG. 2 is comfortable for men, but less so for women, especially when the harness is fastened snugly to the torso. Ideally, the harness should be comfortable to wear by either sex. FIG. 8 is a perspective view of a preferred unisex harness for use with the invention. The harness 20 has a back panel 26 that extends across the upper portion of the golfer's back when the harness is worn. Two sternum straps 90 and 92 are provided that extend from the back panel 26 and wrap around the torso to the front of the golfer at approximately the level of the sternum, just below the breasts for a woman golfer. The strap 90 has a patch of pile fastener 104 on the outer side of the strap and a patch of hook fastener 98 on the "inner" side of the strap 90. The strap 92 has an elongate patch 100 of pile fastener on the "outer" surface as shown. The sternum straps 90 and 92 fasten to each other about the sternum of the golfer by means of hook patch 98 fastening to pile patch 100. The harness 20 also has a pair of shoulder straps 94 and 96 which extend over the shoulder of the golfer and cross in the upper front of the chest above the sternum, between the breasts. The strap 94 has a hook patch 102 which fastens to the pile patch 104, and strap 96 has a hook patch 106 that also attaches to the pile patch 104. The back panel has a grommet 82 for purposes described previously. The outer surface of the back panel has a VELCRO-type patch of hook or pile fastener (not shown) for attachment of the first end of the wand in the manner described previously. The harness 20 is preferably made from a low-stretch or non-stretchable, breathable, medium to heavy weight material such as cotton or nylon, but could be made from other materials such as canvas or leather. The use of elastic materials may be incorporated into the harness if desired to give a increased snug fit of the harness over the clothing and to allow the harness to easily accommodate a twisting movement of the torso.

In use, and as described above in connection with FIG. 6A–6F, when the golfer stands opposite a golf ball to be struck and in a position square to the hole. In accordance with accepted golf instruction and as shown in FIG. 6A, the golf ball is an inch or two to the right of a line extending forward from the golfer's left foot (for a right handed golfer). The wand is oriented to the side of the golfer in the general direction of the desired destination of the ball. A key ingredient in developing a successful back swing is the proper amount of rotation of the torso and back, and this is where the wand and harness, connected to each other as described above, assist the golfer. The golfer, holding the club, executes the back swing. In the process of executing the back swing, the golfer's rotates the torso and back, and thus the wand, attached to the harness and pointing out the side of the golfer, is swung around to point in a direction generally in front of the golfer and slightly downward towards the ground in front of the golfer as shown in FIG. 6C. As the second or free end of the wand comes around generally in front of the golfer, the visual observation of the position of the free end of the wand relative to the golf ball gives the golfer has an idea of how much the back has been rotated. When the free end of the wand lies roughly in the same plane as a plane containing the golf ball and the golfer's eye, or perhaps has been rotated just slightly past the line of sight to the golf ball, the golfer's back and torso have been rotated the proper amount to execute a golf swing in accordance with a generally accepted desirable golf swing form.

Preferably, and as noted above, the first end of the wand 30 is attached to the back panel of the garment or harness 20 in a position to the side of the spine and in the mid-scapula portion of the back, i.e., in the same elevation as the middle of the scapula and just to the side of the spine, on the left side of the back for a right-handed golfer and on the right hand side of the spine for a left-handed golfer. With the first end of the wand in this position, the golfer rotates their torso such that the free end of the wand comes into approximate visual alignment with a plane containing the golf ball, i.e., the free end lies approximately in a plane containing the golfer's eye and the golf ball. This visual alignment between the golfer's eye, the free end of the wand and the golf ball indicates that the golfer's back has rotated the proper amount, and thus is in accordance with a generally accepted and desired golf swing form. Precise visual alignment between the golf ball and the free end of the wand is not necessary, the general idea is that when the free end of the wand has is generally coincident with plane containing the golfer's eye and the ball the proper amount of torso rotation has occurred. Further, precise visual alignment is not required since it depends on the length of the wand and position of the wand on the golfer's back. However, for best results, the wand is given a length of between roughly 24 and 28 inches (or is extended to such a length) and is positioned in the back panel of the harness as described above. Further, it is possible that the back may intentionally not be rotated such that the tip of the wand lies in the plane of the ball and the golfer's eye, thus the visual relationship may vary depending on the desired characteristics of the back swing. However, for best results, the first end of the wand is mounted to the back panel as described and rotated into rough alignment with a plane containing the golf ball and the golfer's eye.

After execution of the swing, the golfer may push the tip of the wand 30 up more or less to a vertical orientation so as to be out of the way. The golf club may be useful for this purpose, or the golfer may have assistance from a companion.

In accordance with the essential teachings of the invention described herein, the harness 20 itself may take any of a variety of forms, the main idea being that the harness is wearable and has a panel (i.e., a surface of material) or other type of structure that covers the back at a desired location for attachment (either permanently or temporarily) of the wand. Preferably, the harness makes a fairly snug and secure fit over the golfer's clothing, to thereby prevent too much slop and play in the action of the wand during the back swing. While a conventional back brace, modified as described herein, worn in the upper portion of the torso has been found to be a satisfactory harness for the invention, other types of devices may be suitable, such as the harness of FIG. 8. These harnesses may be either custom designed for the use described herein, or other garments may be modified to provide the wand attachment means (hook and pile, pocket, straps, etc.) at a desired location and provided with reinforcing or rigidifying structure if needed.

While the term "harness" has been used generically to describe the garment worn by the golfer, the term "harness"

as used herein and in the claims is intended to encompass not just the particular garments described herein, but rather it is also intended to encompass other types of devices that are wearable by the golfer over the golfer's torso and which have a back panel or equivalent structure that can accommodate the attachment of the wand.

The invention having been described in detail above, it will be appreciated that various modifications may be made to the preferred embodiments, in terms of the harness worn, the particular shape or features of the wand, and the manner in which the wand is attached to the harness, without departure from the true scope and spirit of the invention. This true scope and spirit is defined by the appended claims, to be interpreted in light of the foregoing specification.

I claim:

1. A golf swing teaching aid for a golfer, comprising, in combination:

a harness to be worn by the golfer having a back portion thereof that covers at least a portion of the golfer's back when the harness is worn by the golfer, including the mid-scapula portion of the golfer's back; and an elongate, straight wand having a first end and a second end, said first end of said wand comprising means for removably attaching said first end of said wand to said back portion of said harness in a location covering said mid-scapula portion of the golfer's back and to the side of the center line of the back in a manner such that, when said first end of said wand is so attached to said back portion and said harness is worn by the golfer, said wand extends laterally outward from said back portion of said harness substantially to the side of the golfer and generally parallel to a plane containing said golfer's back;

whereby said second end of said wand comes into visual alignment with a golf ball positioned in front of the golfer when the golfer wears said harness with said wand attached thereto and executes a back swing for striking said golf ball in accordance with a desired golf swing form, thereby indicating that the proper amount of shoulder rotation has occurred for said back swing.

2. The golf swing teaching aid of claim 1, wherein said second end of said wand comprises a round ball assisting the golfer to align the second end of the wand with the golf ball during the back swing.

3. The golf swing teaching aid of claim 1, wherein said harness comprises a back support to be worn by the golfer.

4. The golf swing teaching aid of claim 1, wherein said first end of said wand attaches to said back portion of said harness in a location such that, when the harness is worn by the golfer, the first end of said wand is located to the side of a centerline of said back panel coinciding with the golfer's spine.

5. The golf swing teaching aid of claim 1, wherein said wand further comprises a plurality of sections that telescope relative to each other to thereby permit adjustment of the length of the wand.

6. The golf swing teaching aid of claim 5, wherein said wand, when said telescoping sections are fully extended, has a length of between 24 and 44 inches.

7. The golf swing teaching aid of claim 1, wherein said back portion of said harness comprises a back panel and said first end of said wand attaches to said back panel of said harness by complementary hook and pile fastening means affixed to said back panel and said first end of said wand.

8. The golf swing teaching aid of claim 1, wherein said back portion of said harness further comprises a pocket for receiving said first end of said wand in a manner such that said wand extends laterally outward from said back portion of said harness substantially to the side of the golfer.

9. The golf swing teaching aid of claim 1, wherein said wand has a length of between 18 and 44 inches.

10. The golf swing teaching aid of claim 1, wherein said wand comprises:

an elongate telescoping member having a first end and a second end;

a substantially flat base member having a mounting surface with a portion thereof covered with a fastener selected from the group consisting of complementary hook and pile fastening means for removably fastening said base member to said back portion of said harness; and a wand receiving member having a first portion pivotably connected to said base member and a second portion connected to said elongate telescoping member.

11. The golf swing teaching aid of claim 10, further comprising an object mounted to said second end of said telescoping member to assist the golfer is visual perception of the location of said second end of the wand.

12. The golf swing teaching aid of claim 11, wherein said object comprises a ball-shaped object.

13. The golf swing teaching aid of claim 12, wherein said ball-shaped object is given a color or other surface characteristics to give said ball-shaped object a distinct visual appearance.

14. The golf swing teaching aid of claim 1, wherein said harness comprises a back panel, a pair of sternum straps extending laterally from said back panel when the harness is worn by the golfer, and a pair of shoulder straps extending from a top portion of said back panel when the harness is worn by the golfer.

15. A golf swing teaching aid for a golfer, comprising, in combination:

a harness to be worn by the golfer having a back panel that covers at least a portion of the golfer's mid-scapula region of the golfer's back when the harness is worn by the golfer; and an elongate, straight telescoping wand having a first end and a second end, said wand further comprising a base member;

said base member of said wand removeably attachable to said back panel of said harness in the region of the back panel covering the mid-scapula region of the golfer's back, said base member further comprising a pivot means for enabling said wand to pivot relative to said harness about a point between a first position and a second position, wherein, when said first end of said wand is attached to said back panel of said harness and is in in said first position and said harness is worn by the golfer, said wand extends laterally outward from said back panel of said harness substantially to the side of the golfer and generally parallel to a plane containing said golfer's back;

whereby said second end of said wand comes into a visual alignment relationship with a golf ball positioned in front of the golfer when the golfer wears said harness with said wand attached thereto and executes a back swing for striking said golf ball in accordance with a desired golf swing form, thereby indicating that the proper amount of shoulder rotation has occurred for said back swing.

16. The golf swing teaching aid of claim 15, wherein said second end of said wand comprises a distinctive object assisting the golfer to align the second end of the wand with the golf ball during the back swing.

17. A method of improving the swing of a golfer, comprising the steps of positioning the golfer adjacent to a golf ball to be stuck by the golfer in a manner such that a plane passing through the golfer's back approximately coincides with the desired destination for the golf ball and said ball is in front of the feet of the golfer;

wearing a harness on the torso of the golfer, said harness comprising a back panel covering a portion of the golfer's back in the mid-scapula region of the back and an elongate, straight wand having a first end attached to said back panel of the harness in said portion covering said mid-scapula region of said back, and a second free end, said wand extending laterally outward from the harness with the wand oriented substantially in said plane and said second free end pointing generally in the direction of the desired destination of said golf ball; and executing a back swing such that the golfer's back is rotated from a first condition, in which said wand is oriented substantially in said plane, to a second condition, in which said wand is oriented generally towards said golf ball such that said second free end of said wand comes into visual alignment with a plane containing an eye of the golfer and the golf ball, thereby indicating that the proper amount of shoulder rotation has occurred for said back swing.

18. The method of claim 17, wherein the wand comprises a telescoping member having a first end and a second end, and wherein said wand is extended to a length of between 18 and 44 inches during the step of executing the back swing.

* * * * *